US006560908B2

(12) United States Patent
Murello

(10) Patent No.: US 6,560,908 B2
(45) Date of Patent: May 13, 2003

(54) FIRING PIN MOUNTING ASSEMBLY FOR A FIREARM

(75) Inventor: Johannes Murello, Deisslingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/916,807

(22) Filed: Jul. 27, 2001

(65) Prior Publication Data

US 2002/0046478 A1 Apr. 25, 2002

Related U.S. Application Data

(63) Continuation of application No. PCT/EP00/00645, filed on Jan. 27, 2000.

(30) Foreign Application Priority Data

Jan. 28, 1999 (DE) ..... 199 03 323

(51) Int. Cl.[7] ..... F41A 19/13
(52) U.S. Cl. ..... 42/69.02
(58) Field of Search ..... 42/69.01, 69.02, 42/69.03; 89/147, 195, 196

(56) References Cited

U.S. PATENT DOCUMENTS

| | | | | | |
|---|---|---|---|---|---|
| 3,665,630 | A | * | 5/1972 | Taylor | 42/12 |
| 3,712,217 | A | * | 1/1973 | Little et al. | |
| 3,721,032 | A | * | 3/1973 | Shum, Jr. et al. | 89/26 |
| 3,757,447 | A | * | 9/1973 | Rowe | 42/51 |
| 5,778,587 | A | | 7/1998 | Brandl et al. | 42/70.08 |

FOREIGN PATENT DOCUMENTS

| | | | | |
|---|---|---|---|---|
| AT | 90 497 | * | 4/1922 | 42/69.02 |
| AT | 350 439 | | 5/1979 | |
| DE | 73632 | | 7/1892 | |
| DE | 88386 | | 7/1892 | |
| DE | 88386 | | 9/1896 | |
| DE | 334448 | | 3/1921 | |
| DE | 741616 | | 12/1943 | |
| DE | 196 05 851 A1 | | 8/1997 | |
| FR | 382 460 | | 2/1908 | |
| FR | 954 474 | * | 12/1949 | 42/69.02 |
| FR | 2 609 538 | | 7/1988 | |
| GB | 803034 | | 10/1958 | |

OTHER PUBLICATIONS

*International Search Report* corresponding to International Patent Application Ser. No. PCT/EP00/00645, European Patent Office, dated Apr. 13, 2000, 4 pages.

*International Preliminary Examination Report* with *Translation* corresponding to International Patent Application Ser. No. PCT/EP00/00645, International Bureau of WIPO, dated Apr. 19, 2001, 10 pages.

International Search Report PCT Application No. PCT/EP00/00645 mailed Feb. 28, 2000.

International Preliminary Examination Report dated Apr. 19, 2001, PCT Application No. PCT/EP00/00645.

* cited by examiner

*Primary Examiner*—Stephen M. Johnson
(74) *Attorney, Agent, or Firm*—Marshall, Gerstein & Borun

(57) ABSTRACT

An assembly for mounting a firing pin to a bolt assembly of a firearm is provided and includes a bolt assembly adapted for mounting to the firearm, a firing pin mounted to the bolt assembly for reciprocating movement relative to the bolt assembly, and a retaining member releasably engaging a portion of the bolt assembly and slidably engaging a rearward portion of the firing pin. The retaining member is shiftable between an engaged position in which the retaining member is secured to the bolt assembly and a release position in which the retaining member and the firing pin are removable from the bolt assembly. The retaining member is biased against the portion of the bolt assembly when the retaining member is in the engaged position.

20 Claims, 1 Drawing Sheet

FIRING PIN MOUNTING ASSEMBLY FOR A FIREARM

RELATED APPLICATION

This patent is a cont. of 35 U.S.C. §120 from International Application No. PCT/EP00/00645, which was filed on Jan. 27, 2000.

FIELD OF THE INVENTION

The present invention relates generally to firearms, and more specifically to a firing pin mounting assembly for a firearm.

BACKGROUND OF THE INVENTION

The firing pin in firearms should be inspected occasionally in order to determine if problems exist, such as compression or cracking. These problems can occur if the firing pin is not properly work-hardened from manufacturing imprecision, or if the firing pin strikes an unduly hard base, for example, by penetration of a jamming sand grain. Such defects occur extremely rarely, but cannot be fully ruled out.

If the weapon has fallen into water or is very strongly soiled, the firing pin should also be removed in order to be able to clean the firing pin as well as the guide hole that receives the firing pin.

The firing pin is generally only disassembled by gunsmiths or technical personnel, and thus disassembly does not normally occur within the ordinary scope of breakdown of the weapon. Soldiers are even expressly forbidden to disassemble individual parts, like the firing pin, in modem rapid fire weapons. The soldier may only break down his weapon to the extent absolutely required for normal cleaning and care.

In firing pin mounting assemblies, it is known to have a cross slide (DE-PS 741 616). However, such a cross slide requires a guide whose manufacture is expensive. A cross slide that serves as a firing pin safety is also known from DE 196 05 851.

FR 2 609 538 (Manurhin) concerns a device with convertible firing pins, so that the same firing pin can be used for central and edge-fired cartridges. The firing pin is secured by a transverse pin that can move lengthwise relative to the firing pin, but sits firmly and not spring-loaded in the weapon.

DE 334 448 C (Walther) concerns a retaining pin that moves longitudinally and runs transverse to the firing pin, which is connected in one piece to the extractor via a leaf spring section. However, the retaining pin itself sits firmly and not spring-loaded in the bolt assembly of the weapon.

DETAILED DESCRIPTION OF THE DISCLOSED EMBODIMENT

Figure 3:
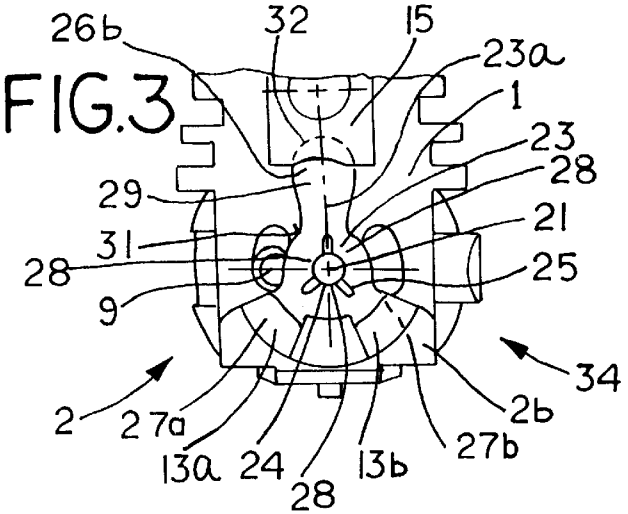
FIG. 3 is a rear elevational view of the bolt assembly of FIG. 1 and illustrating the retaining member in the engaged or locked position.

The following description of the disclosed embodiment is not intended to limit the scope of the invention to the precise form or forms detailed herein. Instead, the following description is intended to be illustrative of the principles of the invention so that others may follow its teachings.

In the interest of simplicity, position designations in the subsequent description assume the normal use position of a firearm with a horizontal bore axis (barrel center axis), in which the direction of shooting points "forward." The longitudinal axis of the firing pin (discussed below) generally coincides with the barrel center axis.

Referring now to the drawings, a bolt assembly 2 formed from a bolt carrier 1 and a bolt head 3 is shown in the drawings. The bolt assembly 2 includes a front end 2*a* (FIGS. 1 and 2) and a rear end 2*b* (FIGS. 1–4). The bolt carrier 1 and the bolt head 3 have an elongated hole 4 in the center in which a firing pin 5 sits. The firing pin 5 includes a longitudinal axis 5*a* (FIG. 2) and is forced rearward by a firing pin spring 7. The firing pin 5 is shiftable along the axis 5*a* between the rearward position (shown in FIG. 2) and a forward position as is known in the art (not shown, but slightly forward or to the left of the position shown in FIG. 2 as would be known to those skilled in the art).

Figure 4:
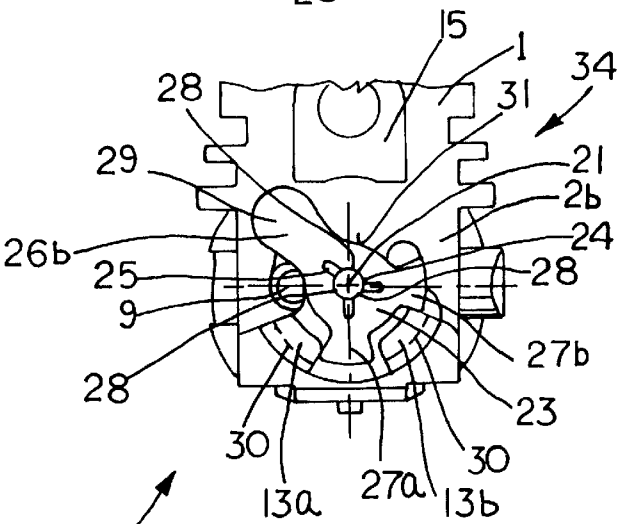
FIG. 4 is a rear elevational view similar to FIG. 3 but illustrating the retaining member rotated to the released or unlocked position.
Figure 1:
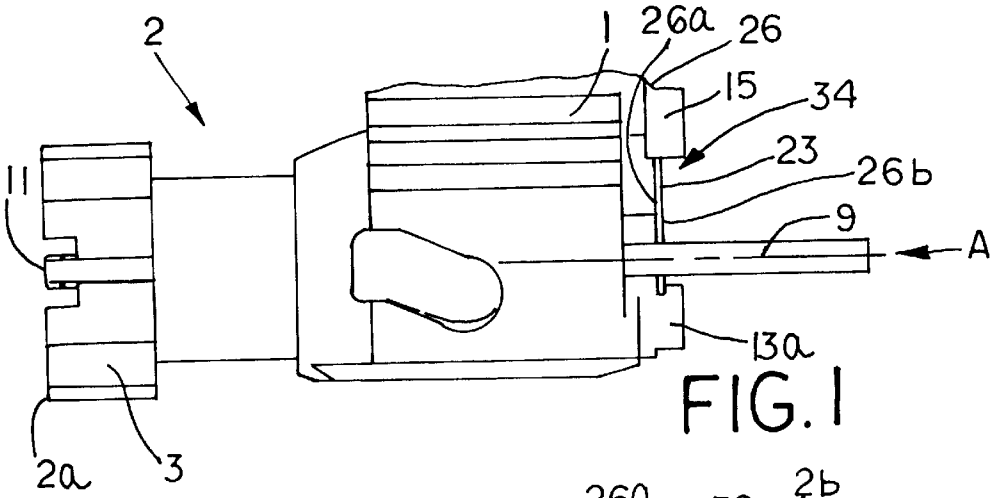
FIG. 1 is a side elevational view of a firing pin mounting assembly constructed in accordance with the teachings of the present invention, the firing pin mounting assembly is shown securing the firing pin to the bolt assembly of a rapid fire weapon.
Figure 2:
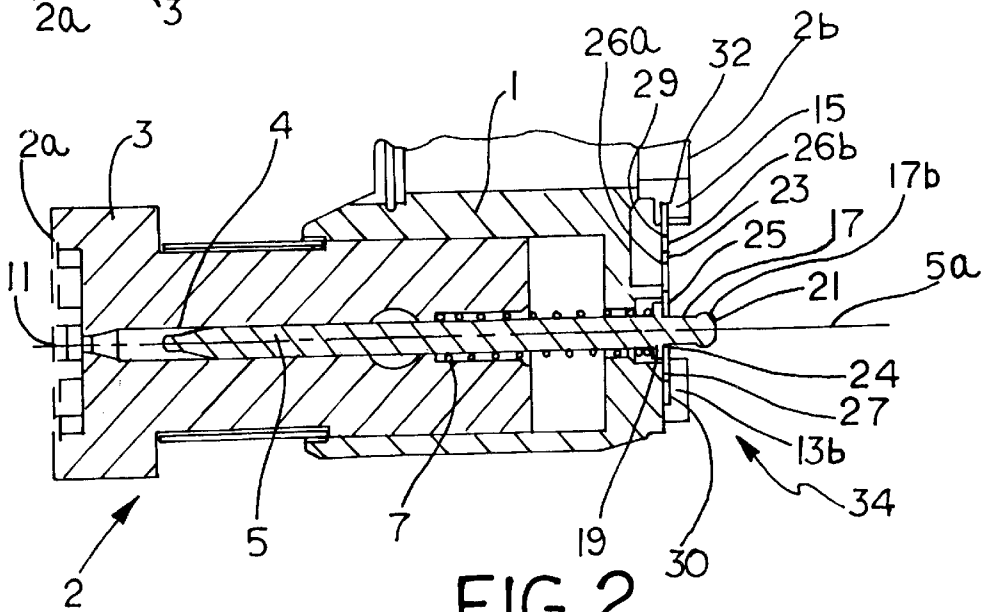
FIG. 2 is a cross sectional view of the firing pin mounting assembly of FIG. 1 taken along a longitudinal centerline of the bolt assembly.

As shown in FIGS. 1, 3 and 4, an ejector 9 passes through the bolt assembly 2 next to the firing pin 5 and generally parallel to the firing pin 5. As shown in FIGS. 1 and 2, an extractor claw 11 is positioned on the front end 2*a* of the bolt assembly 2, generally to the side on the outermost edge of the bolt head 3.

The firing pin 5 includes an elongated section 17 disposed toward a rearward end 17*b*. The elongated section 17 is bounded toward the front (to the left of FIGS. 1 and 2) by a shoulder 19, and bounded to the rear (to the right of FIGS. 1 and 2) by a thickened or widened rear end 21. Both the shoulder 19 and the widened rear end 21 have a larger diameter than the elongated section 17.

A retaining disk 23 is provided, which is preferably generally flat, and which preferably has an overall Y-shape (FIGS. 3 and 4). The retaining member is preferably constructed of spring steel, and includes an aperture 24, which is generally centrally located at the intersection point of a plurality of radially outwardly extending arms 27*a*, 27*b* (shown in FIG. 4 and shown partially obscured in FIG. 3) and 29. The arms 27*a* and 27*b* are preferably shorter than the arm 29. A center line 29*a* of the arm 29 generally lies on a vertical axis 23*a* of the retaining member when the retaining disk is in the position of FIG. 3. The axis 23*a* also lies generally along a vertical height axis of the weapon and the retaining disk 23 is generally symmetrical about the axis 23*a*. The retaining disk includes a first surface 26*a* and a second surface 26*b*.

Three short slits 25 extend radially outwardly from the aperture 24 of the retaining disk 23, and define a plurality of tabs 28 (FIGS. 3 and 4), which tabs 28 can deflect or otherwise spring out from the plane of the retaining disk 23. The Y-shaped retaining disk 23 in the region of the intersection of three arms 27*a*, 27*b* and 29 has a section with a circular arc-shaped peripheral edge 31 which is concentric to the aperture 24.

Preferably, the retaining disk 23 may be assembled onto the firing pin 5 by pressing the widened rear end 21 through the aperture 24. The tabs 28 separated by the slits 25 then deflect elastically and allow the widened rear end 21 to pass through the hole 24 (the hole 24 by itself is too small to permit the widened rear end 21 to pass through). The tabs 28 then spring back such that the aperture 24 slidably receives the elongated section 17. Thus, the retaining disk 23 slidably engages the elongated section 17 of the firing pin 5 with a limited clearance thus permitting limited axial movement of the firing pin 5 relative to the retaining disk 23. Movement of the retaining disk 23 relative to the firing pin 5 is generally limited by the shoulder 19 and the widened rear end 21. It will be noted that the retaining disk 23 may be assembled with either of the surfaces 26*a*, 26*b* facing forward due to the symmetry of the retaining disk 23 about the axis 23*a*.

Three brackets 13*a*, 13*b* and 15 are arranged on the rear end 2*b* of the bolt assembly 2. The brackets are spaced to be complementary to the spacing of the arms 27*a*, 27*b* and 29 of the retaining disk 23. Each of the two lower brackets 13*a*, 13*b* include a peripheral groove 30. Both peripheral grooves 30 are opened radially inward and have roughly the same radius around the firing pin 5. The spacing in the peripheral direction between the lower brackets 13*a*, 13*b* dimensioned so that when the retaining disk 23 is in a release position (FIG. 4), the arm 27*a* is disposed between the brackets 13*a* and 13*b*, such that the retaining disk 23 may be removed in the rearward direction without interfering with the brackets 27*a*, 27*b* and 29. In the retaining position (FIG. 3) on the other hand, the radially outermost ends of the two short arms 27*a*, 27*b* engage the peripheral grooves 30 of the lower brackets 13*a*, 13*b*, respectively.

The bracket 15 preferably has a forward facing surface which defines therein a recess 32 (FIGS. 2 and 3). The recess 32 is sized and shaped to receive at least an end portion of the arm 29. A base of the recess 32 preferably lies roughly in the same plane as the rear edges of the peripheral grooves 30 in the lower brackets 13*a*, 13*b*.

The peripheral dimension of the upper bracket 15 is chosen so that, when the retaining disk 23 is in the release position (FIG. 4), the arm 29 will emerge laterally in front of the upper bracket 15 and the retaining disk 23 can be removed from the bolt assembly 2 in conjunction with the attached firing pin 5.

In the retaining position, on the other hand, the long peripheral bracket 29 (optionally with spring bias), sits in the recess 32 of the upper bracket 15. The side surfaces of this recess 32 are sized to receive the end portion of the arm 29, and thus will prevent the retaining disk 23 from being unintentionally rotated.

If, however, the long peripheral bracket 29 is bent or pushed forward from the rear with the finger (elastically), then it disengages from the recess 32 and can be pivoted by roughly 45° clockwise or counterclockwise. The retaining disk 23 then reaches its release position (FIG. 4) in which all of the arms 27*a*, 27*b* and 29 are released from their corresponding brackets 13*a*, 13*b*, 15, respectively.

Referring now to FIGS. 3 and 4, the retaining disk 23 can assume a retaining position or engaged position (FIG. 3) or a release position (FIG. 4). In the retaining position of FIG. 3 the firing pin 5 is fastened in the bolt carrier 1 of the bolt assembly 2. In the release position of FIG. 4 the retaining disk 23 is rotated in its plane by an angle of about 45° relative to the retaining position, such that the retaining disk 23 and the firing pin 5 may be removed together.

In the disclosed embodiment, the retaining disk 23 is not only secure from being lost because it is securely fastened to firing pin 5, but the component created from the retaining disk 23 and firing pin 5 is also bulkier than those parts taken alone, so that (in contrast to the firing pin 5 alone), the component cannot be lost without difficulty.

In the disclosed embodiment, during movement of the components of the bolt assembly 2, which can be particularly intense and persistent in long-term fire, no force components occur in the peripheral direction. Consequently, there is no hazard that the recess 32 will wear in the upper bracket 15. The weight of the retaining disk 23, which consists, for example, of thin spring steel or a thin elastic plastic plate, is also so limited that the long arm 29 does not jump out from the recess 32 in the upper bracket 15 as a result of inertial forces. In the interest of safety, however, the bottom of this recess 32 can lie in front (to the left when viewing FIG. 2) and in front of the plane of the grooves 30 in the lower brackets 13*a*, 13*b*, such that the long arm 29 fits in the recess 32 under a biasing force.

Thus, in accordance with the disclosed embodiment, an improved firing pin mounting assembly 34 is provided. An improved firing pin mounting assembly 34 should preferably be simply released and mounted without a tool and if possible have no small parts that are vulnerable to being misplaced.

In further accordance with the disclosed embodiment, the retaining disk 23 extends across the firing pin 5 and is mounted to move longitudinally relative to the firing pin 5, with the retaining disk 23 optionally being brought into spring-loaded engagement with the bolt assembly 2.

By overcoming the spring force that serve to maintain the retaining disk in the engaged position of FIG. 3, the retaining disk 23 can be released from the bolt assembly 2 and then removed together with the firing pin 5. The firing pin 5 is connected to the retaining disk 23 as outlined above such that the firing pin 5 is free to execute the longitudinal movement necessary for firing a shot from the weapon.

Alternatively, the retaining disk 23 may be in the form of a spring pin that passes through an elongated hole in the firing pin 5 and is bent on both sides of the firing pin 5.

To overcome the spring force without a tool, the retaining disk 23 is mounted adequately accessibly so that it can be pushed against and dislodged simply with a finger. When the retaining disk 23 is thus released, it is still fastened to the firing pin 5 and therefore cannot be lost.

The spring force can originate, for example, from a filing pin spring 7, which forces the firing pin 5 to the rear (to the right when viewing FIGS. 1 and 2) so that the firing pin 5 does not continuously protrude from the percussion base of the bolt assembly 2. The shoulder 19 on the firing pin is forced or biased against the retaining disk 23 the action of the firing pin spring 7, and in so doing loads the retaining disk 23 rearward against the brackets 13,a, 13*b* and 15. The shoulder 19 may take a variety of forms so as to engage the retaining disk 23.

Pressing on the firing pin 5 may allow one to loosen the retaining disk 23 in order to raise it by the bias exerted by the firing pin spring.

The retaining disk 23 can be moveable in translatory manner across the longitudinal center axis, but is preferably configured and arranged as a rotary retaining disk 23. Should the rotary retaining disk 23 loosen from its engagement in the bolt assembly 2 by an error in the assembled weapon or should the bolt assembly inadvertently be inserted in to the weapon with the rotary retaining disk 23 not properly incorporated, then the retaining disk 23 does not protrude laterally above the bolt assembly, as in a retaining disk 23 that moves in translatory fashion. It therefore cannot cause any jamming either.

The center of rotation of the rotary retaining disk 23 is chosen as central as possible in the bolt assembly for the same reason so that the rotary retaining disk 23 can rotate around the firing pin 5.

The firing pin must now be moveable in the longitudinal direction with the rotary retaining disk 23 fixed in order to be able to fire a cartridge. In order for the rotary retaining disk 23 not to hamper this longitudinal movement of the firing pin 5. The firing pin 5 includes the elongated section 17 of reduced diameter which passes through the hole 24 of the rotary retaining disk 23. The shoulder 19 and the widened end 21, both having increased diameter relative to the elongated section 17, cannot pass through the hole 24.

For manufacture it would be possible to divide the firing pin, introduce one part into the hole of the rotary retaining disk 23 and then assemble the firing pin.

However, it is preferable that the material of the rotary retaining disk 23 be adapted by permanent deformation or elastic deformation to the reduced cross section of the length section so that it is particularly easy to assemble and not vulnerable to being lost. To facilitate elastic or plastic deformation, the radial slits 25 are formed that begin from the hole 24 of the rotary retaining disk 23.

The rotary retaining disk 23 can have perforations or axial protrusions that engage in protrusions on the bolt assembly. However, peripheral brackets are preferably formed on the rotary retaining disk 23 which extend radially outward, lie within the bolt assembly cross section in each rotational position of the retaining disk 23 and engage behind protrusions on the bolt assembly from the front in the retaining position. Because of this, the largest possible but also simplest possible design of the rotary retaining disk 23 is obtainable so that it can be engaged without difficulty but cannot adversely affect the function of the bolt assembly in any position.

Because of this, it is possible to form the rotary retaining disk 23 from a spring steel disk that can be produced cost effectively by punching.

This spring steel disk is preferably symmetric with reference to the height axis. This is particularly advantageous in a weapon with alternating cartridge ejection direction, since there the ejector alternately sits on one or the other side of the bolt assembly. The mentioned symmetry also has the advantage that incorrect assembly is not possible because of an incorrectly oriented spring steel disk. Because of the symmetry of the spring steel disk, which of its surfaces faces forward or rearward does not matter.

Preferably, the spring steel disk has two short peripheral brackets on the bottom and one long peripheral bracket on the top center. The long peripheral bracket engages in a locking recess from the front and under spring tension of the spring steel disk, the protrusion being formed on the front side of a protrusion of the bolt carrier. For unlocking, the long peripheral bracket need only be pushed from the rear forward with a finger in order to be lifted forward out of the catch. Oblique loading of the peripheral bracket with the finger of the user then rotates the spring steel disk far enough so that it is released from all protrusions.

The applicant has devised an automatic firearm applied for a patent thereon (German Patent Application No. 199 03 327.7 "Bolt mechanism for a firearm", file number of the applicant H0473-084-DEPOOSk), Ser. No. 09/911,008 (priority document PCT/EP00/00551, which application has been filed simultaneously with the present application. In the referenced co-pending application, the bolt head can be incorporated in two different positions in order to permit cartridge ejection alternately to the right or left. The contents of referenced co-pending patent application are expressly included in the present application by reference. Applicant also incorporates by reference herein the contents of co-pending application Ser. No. 09/916,911 (priority document PCT/EP00/00520).

In a preferred variant of the referenced firearm, it is essential to remove the firing pin during conversion of the bolt head. In an ordinary firing pin mount, a tool would be necessary for this purpose. Small parts (for example, a lock washer), which are easily lost or could be damaged during unskillful incorporation, would also be released.

The ejector or ejector pin 9 is provided in many weapons and passes through the bolt assembly 2 parallel to the firing pin 5, especially in the aforementioned automatic weapon in which cartridge ejection can be converted. This ejector 9 must be converted during conversion of cartridge ejection, i.e., disassembled like the firing pin and then reincorporated in the corresponding position.

The firing pin 5 keeps a control bolt (not further shown) in position. If the firing pin 5 is removed, the control bolt can be removed and the bolt head 3 can be removed from the bolt carrier 1. During reassembly, the bolt head 3 can be incorporated in two different positions, either with the extractor claw 11 on the left and the ejector 9 on the right (cartridge ejection leftward) or, as shown, with the extractor claw 11 on the right and the ejector 9 on the left (cartridge ejection rightward). The control bolt is then reinserted and secured with the firing pin 5.

Those skilled in the art will appreciate that, although the teachings of the invention have been illustrated in connection with certain embodiments, there is no intent to limit the scope of this patent to such embodiments. On the contrary, the intention of this patent is to cover all modifications and embodiments fairly falling within the scope of the appended claims either literally or under the doctrine of equivalents.

What is claimed is:

1. An assembly for mounting a firing pin to a bolt assembly of a firearm, the assembly comprising:

a bolt assembly, the bolt assembly adapted for mounting to the firearm;

a firing pin, the firing pin mounted to the bolt assembly for reciprocating movement relative to the bolt assembly; and a retaining member, the retaining member releasably engaging a portion of the bolt assembly and slidably engaging a rearward portion of the firing pin, the rearward portion of the firing pin extending through the retaining member, the retaining member rotatably shiftable about a longitudinal axis of the firing pin between an engaged position in which the retaining member is secured to the bolt assembly and a release position in which the retaining member and the firing pin are removable from the bolt assembly, the retaining member shiftable between the engaged position and the released position in less than a single revolution, the retaining member being biased against the portion of the bolt assembly when the retaining member is in the engaged position.

2. The assembly of claim 1, wherein the firing pin is moveable between a forward position and a rearward position, and including a firing pin spring engaging the firing pin to thereby bias the firing pin toward the rearward position, and wherein the firing pin includes a shoulder, the shoulder engaging the retaining member as the firing pin approaches the rearward position to thereby apply a rearward force to the retaining member.

3. The assembly of claim 1, wherein the retaining member is a spring steel disk.

4. The assembly of claim 1, the bolt assembly including a forward end and a rearward end, and wherein the retaining member includes a first face and a second face, the retaining member being generally symmetrically shaped to thereby permit the retaining member to be mounted to the bolt assembly with either the first face or the second face disposed toward the forward end of the bolt assembly.

5. An assembly for mounting a firing pin to a bolt assembly of a firearm, the assembly comprising:

a bolt assembly, the bolt assembly adapted for mounting to the firearm;

a firing pin, the firing pin mounted to the bolt assembly for reciprocating movement relative to the bolt assembly, a rearward portion of the firing pin including an elongated section bounded by a shoulder and a widened end; and a retaining member, the retaining member releasably engaging a portion of the bolt assembly and slidably engaging the rearward portion of the firing pin, the retaining member shiftable between an engaged position in which the retaining member is secured to the bolt assembly and a release position in which the retaining member and the firing pin are removable from the bolt assembly, the retaining member being biased against the portion of the bolt assembly when the retaining member is in the engaged position, the retaining member including an aperture sized to slidably engage the elongated section, and wherein the retaining member includes a plurality of tabs defined at least in part by a plurality of slits extending radially outwardly from the aperture, the tabs being deflectable to thereby permit the retaining member to be mounted to the firing pin by inserting the widened end through the aperture.

6. An assembly for mounting a firing pin to a bolt assembly of a firearm, the assembly comprising:

a bolt assembly, the bolt assembly adapted for mounting to the firearm;

a firing pin, the firing pin mounted to the bolt assembly for reciprocating movement relative to the bolt assembly; and a planar retaining member, the retaining member releasably engaging a portion of the bolt assembly and slidably engaging a rearward portion of the firing pin, the retaining member shiftable between an engaged position in which the retaining member is secured to the bolt assembly and a release position in which the retaining member and the firing pin are removable from the bolt assembly, the retaining member being biased against the portion of the bolt assembly when the retaining member is in the engaged position; and wherein the bolt assembly includes a plurality of brackets, each of the brackets defining a forward facing seat, and wherein the retaining member includes a plurality of radially extending arms, the arms defined by outwardly extending portions of the planar retaining member and being generally disposed in the plane of the retaining member, the arms and the brackets spaced so that an outer extent of each of the arms engages a corresponding one of the seats when the retaining member is in the engaged position.

7. The assembly of claim 6, wherein the retaining member is a rotatable about an axis of the firing pin between the engaged position and the released position, and wherein the brackets are positioned on the bolt assembly such that each of the radially extending arms is disposed between a pair of the brackets when the retaining member is rotated to the released position.

8. An assembly for mounting a firing pin to a bolt assembly of a firearm, the assembly comprising:

a bolt assembly, the bolt assembly adapted for mounting to the firearm;

a firing pin, the firing pin mounted to the bolt assembly for reciprocating movement relative to the bolt assembly; and a retaining member, the retaining member releasably engaging a portion of the bolt assembly and slidably engaging a rearward portion of the firing pin, the retaining member shiftable between an engaged position in which the retaining member is secured to the bolt assembly and a release position in which the retaining member and the firing pin are removable from the bolt assembly, the retaining member being biased against the portion of the bolt assembly when the retaining member is in the engaged position; and wherein the bolt assembly includes a plurality of brackets, at least one of the brackets defining a recessed seat, at least a second of the brackets defining a groove, and wherein the retaining member includes a plurality of radially extending arms, at least one of the arms engaging the groove and at least a second one of the arms engaging the recessed seat when the retaining member is in the engaged position.

9. The assembly of claim 8, wherein the retaining member is a generally planar spring steel member, and wherein the recessed seat is disposed forwardly of the groove, whereby the second one of the arms is biased against the recessed seat.

10. An assembly for mounting a firing pin to a firearm, the assembly comprising:

a bolt assembly, the bolt assembly adapted for mounting to the firearm, the bolt assembly including a plurality of brackets;

a firing pin, the firing pin mounted to the bolt assembly for reciprocating movement relative to the bolt assembly between a forward position and a rearward position;

a retaining member, the retaining member releasably engaging the brackets of the bolt assembly and slidably engaging a rearward portion of the firing pin, the rearward portion of the firing pin arranged to protrude through the retaining member, the retaining member rotatably shiftable about a longitudinal axis of the firing pin between an engaged position in which the retaining member engages the brackets and a release position in which the retaining member and the firing pin are removable from the bolt assembly; and biasing means for biasing the retaining member against the brackets.

11. The assembly of claim 10, wherein the biasing means is defined at least in part by a firing pin spring and a shoulder on the firing pin, the shoulder sized to abut the retaining member when the firing pin is disposed toward the rearward position.

12. The assembly of claim 10, wherein the rearward portion of the firing pin includes an elongated section bounded by a forward shoulder and a widened rearward end, and wherein the retaining member includes an aperture sized to slidably receive the elongated section.

13. The assembly of claim 10, wherein the retaining member includes a plurality of radially extending arms, and wherein at least one of the brackets defines a recessed seat, the recess seat sized to receive one of the arms to thereby maintain the retaining member in the engaged position.

14. The assembly of claim 13, wherein the arms and the brackets are spaced so that upon rotating the retaining member to the released position each of the arms is disposed between a pair of the brackets.

15. The assembly of claim 10, the bolt assembly including a forward end and a rearward end, and wherein the retaining member is a generally planar spring steel element having a first face and a second face, the retaining member being shaped to thereby permit the retaining member to be mounted to the bolt assembly with either the first face or the second face disposed toward the forward end of the bolt assembly.

16. An assembly for mounting a firing pin to a firearm, the assembly comprising:

a bolt assembly, the bolt assembly adapted for mounting to the firearm, the bolt assembly including a plurality of brackets;

a firing pin, the firing pin mounted to the bolt assembly for reciprocating movement relative to the bolt assembly between a forward position and a rearward position;

a retaining member, the retaining member releasably engaging the brackets of the bolt assembly and slidably engaging a rearward portion of the firing pin, the retaining member rotatably shiftable about an axis of the firing pin between an engaged position in which the retaining member engages the brackets and a release position in which the retaining member and the firing pin are removable from the bolt assembly; and biasing means for biasing the retaining member against the brackets; and wherein the retaining member comprises a spring steel disk element, and further wherein a first one of the brackets includes a groove and a second one of the brackets defines a seat, the seat disposed forwardly of the groove, and wherein the spring steel disk element, the groove, and the seat cooperate to define the biasing means.

17. An assembly for mounting a firing pin to a firearm, the assembly comprising:

a bolt assembly, the bolt assembly adapted for mounting to the firearm, the bolt assembly including a plurality of brackets;

a firing pin, the firing pin mounted to the bolt assembly for reciprocating movement relative to the bolt assembly between a forward position and a rearward position, the firing pin having a rearward portion, the rearward portion of the firing pin includes an elongated section bounded by a forward shoulder and a widened rearward end;

a retaining member, the retaining member releasably engaging the brackets of the bolt assembly and slidably engaging the rearward portion of the firing pin, the retaining member rotatably shiftable about an axis of the firing pin between an engaged position in which the retaining member engages the brackets and a release position in which the retaining member and the firing pin are removable from the bolt assembly, the retaining member including an aperture sized to slidably receive the elongated section;

biasing means for biasing the retaining member against the brackets; and wherein the retaining member includes a plurality of tabs defined at least in part by a plurality of slits extending radially outwardly from the aperture, the tabs being deflectable to thereby permit the retaining member to be mounted to the firing pin by inserting the widened rearward end through the aperture.

18. An assembly for mounting a firing pin a firearm, the assembly comprising:

a bolt assembly, the bolt assembly having a plurality of brackets, the bolt assembly adapted for mounting to the firearm;

a firing pin, the firing pin mounted to the bolt assembly for reciprocating movement relative to the bolt assembly between a forward position and a rearward position; and a generally planar retaining member, the retaining member rotatably moveable about an axis of the firing pin between an engaged position in which the retaining member engages the brackets and a released position in which the retaining member is released from the brackets, the brackets and the retaining member arranged so that the retaining member is biased against at least one of the brackets when the retaining member is in the engaged position; and the retaining member including an aperture sized to receive a narrowed portion of the firing pin, the narrowed portion defined at least in part by a widened rear end and a forward shoulder, the widened rear end and the forward shoulder cooperating with the retaining member to permit limited longitudinal movement of the firing pin relative to the retaining member;

whereby the retaining member and the firing pin may be removed as a single unit when the retaining member is in the released position.

19. An assembly for mounting a firing pin a firearm, the assembly comprising:

a bolt assembly, the bolt assembly having a plurality of brackets, the bolt assembly adapted for mounting to the firearm;

a firing pin, the firing pin mounted to the bolt assembly for reciprocating movement relative to the bolt assembly between a forward position and a rearward position; and a generally planar retaining member, the retaining member rotatably moveable about an axis of the firing pin between an engaged position in which the retaining member engages the brackets and a released position in which the retaining member is released from the brackets, the brackets and the retaining member arranged so that the retaining member is biased against at least one of the brackets when the retaining member is in the engaged position; and the retaining member including an aperture sized to receive a narrowed portion of the firing pin, the narrowed portion defined at least in part by a widened rear end and a forward shoulder, the widened rear end and the forward shoulder cooperating with the retaining member to permit limited longitudinal movement of the firing pin relative to the retaining member, the retaining member further including a plurality of tabs defined at least in part by a plurality of slits extending radially outwardly from the aperture, the tabs being deflectable to thereby permit the retaining member to be mounted to the firing pin by inserting the widened end through the aperture;

whereby the retaining member and the firing pin may be removed as a single unit when the retaining member is in the released position.

20. An assembly for mounting a firing pin a firearm, the assembly comprising:

a bolt assembly, the bolt assembly having a plurality of brackets, the bolt assembly adapted for mounting to the firearm;

a firing pin, the firing pin mounted to the bolt assembly for reciprocating movement relative to the bolt assembly between a forward position and a rearward position; and a generally planar retaining member, the retaining member rotatably moveable about an axis of the firing pin between an engaged position in which the retaining member engages the brackets and a released position in which the retaining member is released from the brackets, the brackets and the retaining member arranged so that the retaining member is biased against at least one of the brackets when the retaining member is in the engaged position, and wherein a first one of the brackets defines a recessed seat and a second of the brackets defines a groove, and wherein the retaining member includes a plurality of radially extending arms, a first one of the arms sized to engage the recessed seat and a second one of the arms sized to engage the groove, the recessed seat disposed forwardly of the groove, and wherein the retaining member is a spring steel element, the groove cooperating with the second arm to bias the first arm against the recessed seat when the retaining member is in the engaged position;

the retaining member including an aperture sized to receive a narrowed portion of the firing pin, the narrowed portion defined at least in part by a widened rear end and a forward shoulder, the widened rear end and the forward shoulder cooperating with the retaining member to permit limited longitudinal movement of the firing pin relative to the retaining member;

whereby the retaining member and the firing pin may be removed as a single unit when the retaining member is in the released position.

* * * * *

UNITED STATES PATENT AND TRADEMARK OFFICE

CERTIFICATE OF CORRECTION

PATENT NO. : 6,560,908 B2
DATED : May 13, 2003
INVENTOR(S) : Johannes Murello

It is certified that error appears in the above-identified patent and that said Letters Patent is hereby corrected as shown below:

Column 7,
Line 61, delete “is a rotatable about” and insert instead -- is rotatable about --.

Column 10,
Lines 28, 29 and 63, delete “pin a firearm” and insert instead -- pin to a firearm --.

Signed and Sealed this

Twenty-first Day of June, 2005

JON W. DUDAS
*Director of the United States Patent and Trademark Office*